US010404002B2

(12) United States Patent
Wang et al.

(10) Patent No.: US 10,404,002 B2
(45) Date of Patent: Sep. 3, 2019

(54) INSULATING BODY FOR A PLUG CONNECTOR

(71) Applicant: HARTING ELECTRIC GMBH & CO. KG, Espelkamp (DE)

(72) Inventors: Xiafu Wang, Dresden (DE); Matthias Keil, Espelkamp (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/771,388

(22) PCT Filed: Oct. 19, 2016

(86) PCT No.: PCT/EP2016/075069
§ 371 (c)(1),
(2) Date: Apr. 26, 2018

(87) PCT Pub. No.: WO2017/072001
PCT Pub. Date: May 4, 2017

(65) Prior Publication Data

US 2018/0337484 A1 Nov. 22, 2018

(30) Foreign Application Priority Data

Oct. 27, 2015 (DE) ..... 10 2015 118 306

(51) Int. Cl.
*H01R 13/426* (2006.01)
*H01R 13/436* (2006.01)

(52) U.S. Cl.
CPC ..... *H01R 13/426* (2013.01); *H01R 13/436* (2013.01)

(58) Field of Classification Search
CPC combination set(s) only.
See application file for complete search history.

(56) References Cited

U.S. PATENT DOCUMENTS 3,987,697 A 10/1976 Wurzel
6,779,763 B2 * 8/2004 Miura ..... F16L 3/13 248/68.1
9,494,258 B2 * 11/2016 Flynn ..... F16L 3/237
(Continued)

FOREIGN PATENT DOCUMENTS

DE 196 09 625 A1 9/1997
DE 20 2012 010 451 U1 2/2013

OTHER PUBLICATIONS

International Search Report and Written Opinion, dated Jan. 17, 2017, for International Application No. PCT/EP2016/075069, 13 pages (with English translation of search report).
(Continued)

*Primary Examiner* — Ross N Gushi
(74) *Attorney, Agent, or Firm* — Seed IP Law Group LLP

(57) ABSTRACT

An insulating body for a plug connector is provided, having at least one seat for a contact, the seat being open in the peripheral direction and surrounding a receiving space for the contact over an angular range which is greater than 180 degrees and smaller than 300 degrees, and wherein at least one peripheral edge of the seat has a guide web provided thereon which is elastic in the radial direction of the seat and which has a wall thickness that is greater at the free end than in the region of the connection to the seat.

10 Claims, 3 Drawing Sheets

(56) References Cited

U.S. PATENT DOCUMENTS

| | | | | |
|---|---|---|---|---|
| 2005/0176265 | A1 | 8/2005 | Jacobs | |
| 2010/0029143 | A1 | 2/2010 | Cossette | |
| 2011/0239411 | A1* | 10/2011 | Yang | H02G 3/32 24/122.6 |
| 2013/0221185 | A1* | 8/2013 | Ogawa | F16L 3/13 248/634 |
| 2015/0093935 | A1 | 4/2015 | Jaschke et al. | |
| 2015/0303606 | A1 | 10/2015 | Singhammer et al. | |

OTHER PUBLICATIONS

International Preliminary Report on Patentability, dated May 1, 2018, for International Application No. PCT/EP2016/075069, 7 pages.

International Written Opinion, dated Mar. 2, 2018, for International Application No. PCT/EP2016/075069, 6 pages. (English Translation).

* cited by examiner

INSULATING BODY FOR A PLUG CONNECTOR

BACKGROUND

Technical Field

This disclosure relates to an insulating body for a plug connector, including at least one seat for a contact, the seat being open in the peripheral direction and surrounding a receiving space for the contact over an angular range which is greater than 180 degrees and smaller than 300 degrees.

Description of the Related Art

Such a seat of the aforementioned type that is open on one side offers the advantage of being elastic so that a contact can be inserted into it, which is then reliably retained there. It is a drawback, however, that it may possibly occur that a contact is pushed in slightly obliquely when it is inserted, so that it is then seated at an angle, rather than being placed in the desired position concentrically within the seat.

It would be basically conceivable to provide additional guide members in the region of the seat, which can serve to prevent that the contact can be inserted in the insulating body with an incorrect orientation. However, since a very large number of contacts are possibly arranged closely next to each other in such an insulating body, the space available for such guide members is very limited. If guide members are used which have a very filigree or delicate design due to the problems of space, there is the problem that they cannot be reliably molded in the injection molding process used for manufacturing the insulating body; a certain minimum wall thickness is required for reliable molding, or very expensive special plastics have to be used for very small wall thicknesses, which can be reliably processed even under these circumstances.

BRIEF SUMMARY

Embodiments of the present invention provide an insulating body of the type initially mentioned to the effect that the installation safety for the contacts is increased with little effort.

According to embodiments of the invention, provision is made in an insulating body of the type initially mentioned that at least one peripheral edge of the seat has a guide web provided thereon which is elastic in the radial direction of the seat and which has a wall thickness that is greater at the free end than in the region of the connection to the seat. Embodiments of the invention are based on the finding that a special configuration of the guide webs allows them to be formed with a comparatively filigree design, without the need to use any expensive special plastics in producing the insulating body. According to aspects of the invention, it has been found that a guide web thickened at its free end can be reliably molded in an injection molding process, even if the wall thickness of the guide web is on the order of 0.4 to 0.8 mm. A guide web of such thinness can be provided even in confined spaces. The guide web ensures that the contact will automatically correctly enter the open seat during insertion. This prevents any incorrect installation.

In some particularly advantageous embodiments, it is provided that at its free end, the guide web has a wall thickness which is between 20% and 70% greater than in the region of the connection to the seat. This increase in wall thickness ensures that a sufficient amount of material is available in the region of the free end of the guide web for the latter to be reliably injection molded.

According to a particularly advantageous embodiment of the invention, two guide webs are provided which are symmetrically opposite to each other. Use of two guide webs will guide a contact into the seat in an optimum fashion during its insertion into the insulating body.

In some instances, it is provided that the free ends of the two guide webs are opposite each other at a distance which is on the order of 10% to 40% of the diameter of the seat. This makes the seat provided for the contact appear to be almost closed when the latter is inserted into the insulating body, thus reducing the risk of misalignment.

In some instances, it is provided that the guide web is curved. This results in a uniform contact of the guide web with the contact.

In some instances, it is provided that the outer surface of the guide web facing away from the seat extends concentrically with the central axis of the seat. This configuration of the outer surface results in a contour of the guide web that is advantageous in terms of injection molding technology.

According to one configuration of the invention, provision is made that the inner surface of the guide web facing the seat extends in a curved shape. This design of the inner surface ensures that the inner surface is in contact with the inserted contact over a large area, that is, without point contact.

An (at least almost) full-surface contact between the contact and the inner surface of the guide web is obtained if the radius of curvature of the inner surface of the guide web substantially corresponds to the radius of the seat.

BRIEF DESCRIPTION OF THE SEVERAL VIEWS OF THE DRAWINGS

Aspects of the invention will be described below with reference to an embodiment which is illustrated in the accompanying drawings, in which.

DETAILED DESCRIPTION

Figure 1:
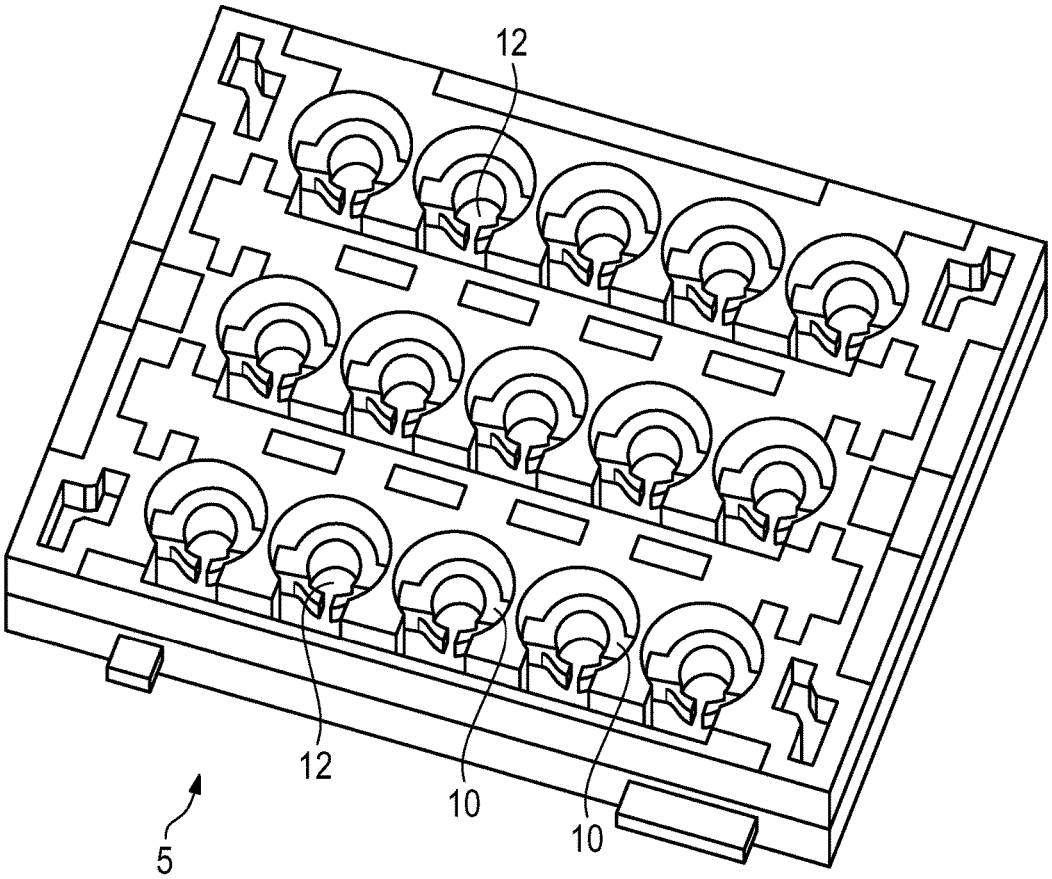
FIG. 1 shows a perspective view of an insulating body having 15 seats for contacts.

FIG. 1 shows an insulating body 5 for a plug connector, which is provided with a total of 15 seats 10 for contacts (not illustrated here).

The insulating body 5 is made from an injection molded plastic material.

Figure 2:
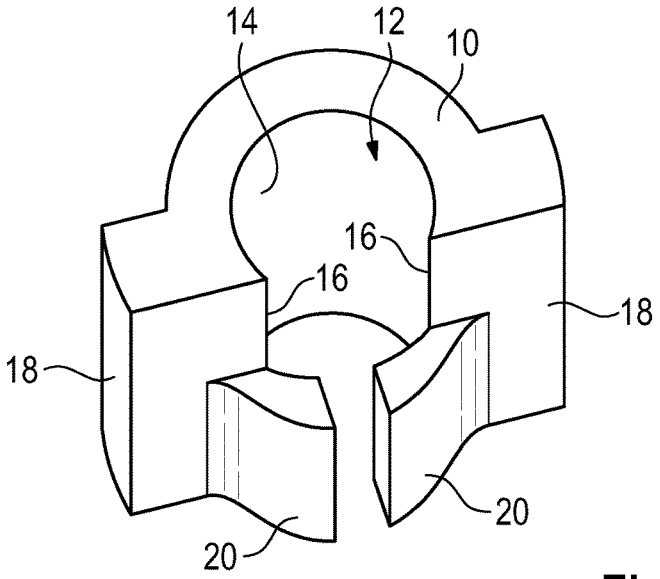
FIG. 2 shows a schematic, perspective view of one seat for one contact.
Figure 3:
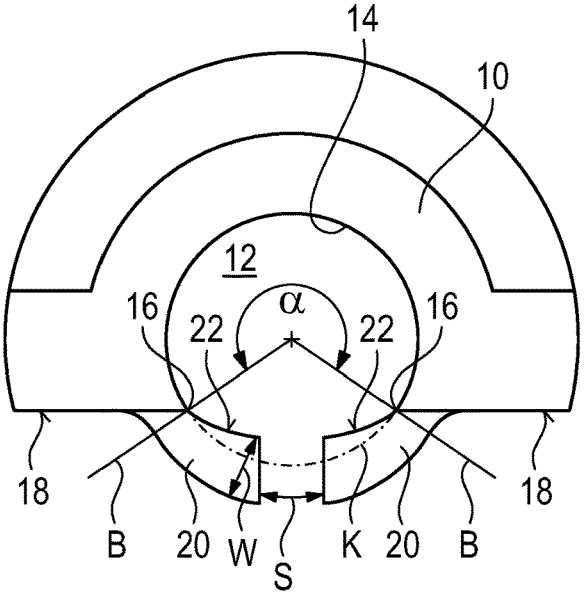
FIG. 3 shows the seat of FIG. 2 in a top view.

FIGS. 2 and 3 show one of the seats 10 in detail. Each seat 10 surrounds a receiving space 12 into which a contact having a circular cross-section can be inserted. As can be seen by the boundary lines B drawn in FIG. 3, the seat 10 encloses the receiving space 12 over an angular range a that is noticeably greater than 180 degrees but amounts to less than 300 degrees. In the exemplary embodiment shown, the angle $\alpha$ is in the range of from 210 degrees to 240 degrees.

The inner surface 14 of the seat 10 has an (at least almost) constant radius of curvature, the radius of curvature substantially corresponding to the radius of the contact to be received in the receiving space 12. In fact, the dimensions of the receiving space 12 are slightly smaller than the cross-section of the contact to be received, so that the contact will slightly elastically widen the seat 10 when it is inserted into the receiving space 12.

Starting from the two peripheral edges 16 of the seat 10, that is, the intersection of the boundary planes B with the seat 10, a respective boundary surface 18 extends here. In the embodiment shown, the two boundary surfaces 18 extend in the same plane.

Starting from each peripheral edge (and also from each boundary surface 18), a respective guide web 20 is provided, which "prolongs" the inner surface 14. In other words: the gap S between the free ends facing each other of the two guide webs 20 is smaller than the distance between the two peripheral edges 16 of the seat 10.

As can be seen particularly in FIG. 2, the height of the guide webs 20, i.e., their extent along the axial direction of the receiving space 12, is smaller than the height of the seat 10. In the exemplary embodiment shown, the height of the guide webs 20 is slightly more than half the height of the seat 10.

As can be seen in FIG. 3 in particular, the guide webs 20 are designed such that their wall thicknesses at the free ends are greater than in the area of the connection to the seat 10.

In the exemplary embodiment shown, the wall thickness W measured in the radial direction is roughly 50% greater at the free ends of the guide webs 20 than the wall thickness in the area of the transition to the seat 10, that is, in the area of the boundary plane B.

As can also be seen clearly in FIG. 3, the guide webs 20 are oriented such that their inner surfaces 22 are positioned within the circular cylindrical contour K, which corresponds to the outer surface of a contact inserted in the receiving space 12.

The function of the guide webs will now be discussed with reference to FIGS. 4 and 5.

Figure 4:
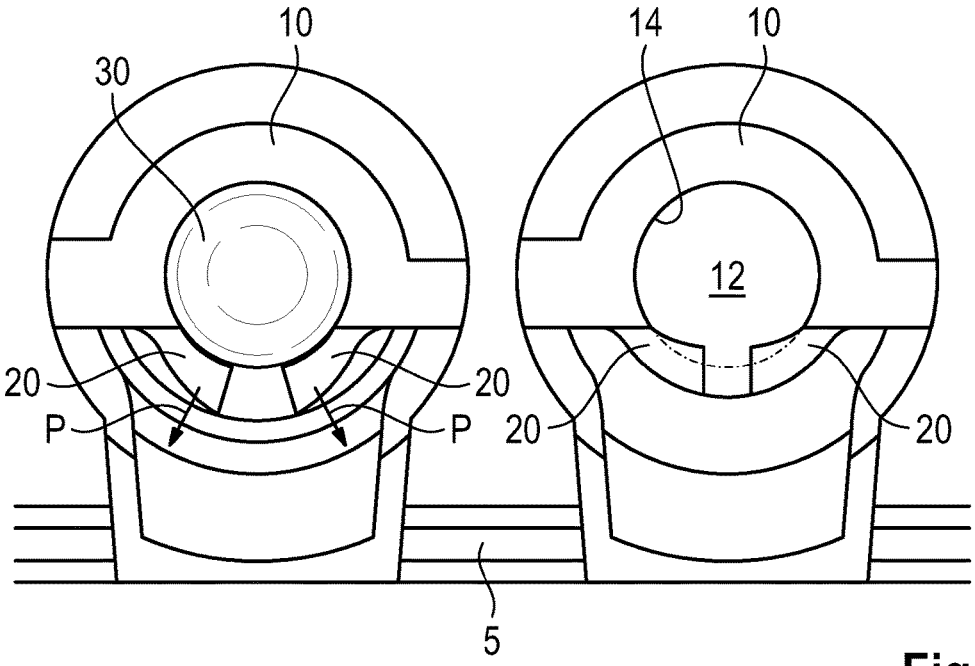
FIG. 4 shows a top view of two seats, with a contact inserted in one of the two seats.
Figure 5:
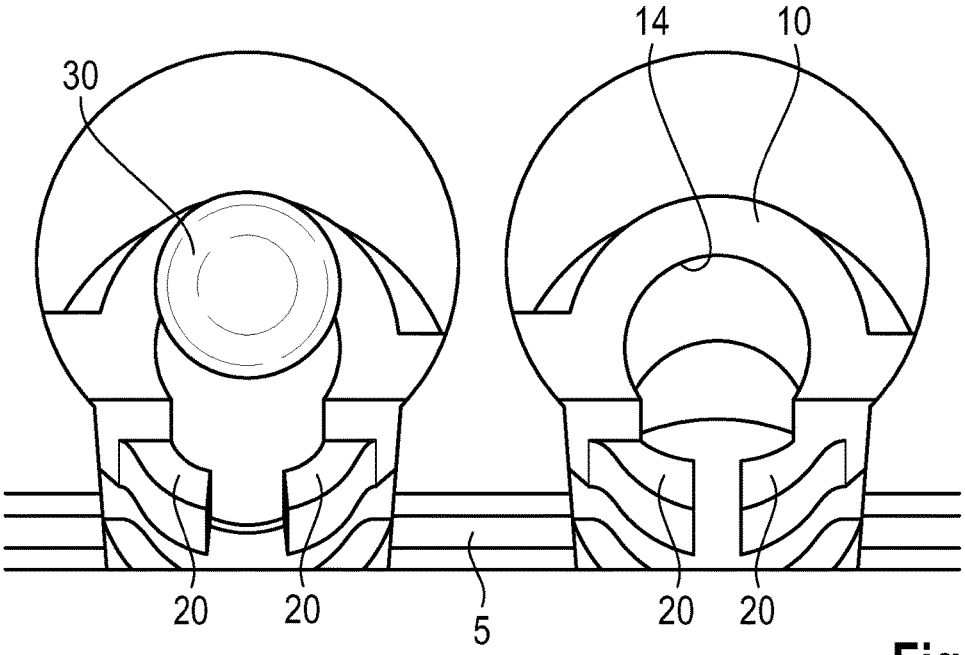
FIG. 5 shows a perspective view of the two seats of FIG. 4.

The illustrations on the right side of each of FIGS. 4 and 5 show that in the initial state, i.e., when no contact is located in the receiving space 12 of the seat 10, the guide webs 20 protrude inward into the receiving space 12 as compared to a circular cylindrical contour. When a contact 30 is inserted in the receiving space 12 (see the illustrations on the left of each of FIGS. 4 and 5), the guide webs 20 are elastically displaced outward by the contact 30 (see arrows P in FIG. 4 on the left). In the process, the guide webs 20 exert a reaction force on the contact 30, which acts on the latter toward the side of the receiving space 12 facing away from the guide webs 20. This reliably ensures that the contact 30 finds its way into the receiving space 12, even though the seat 10 does not fully enclose the contact over 360 degrees, but is open over a large part of the circumference thereof.

The maximum wall thickness of the guide webs 20 is on the order of 0.4 mm to 0.8 mm. In the exemplary embodiment, a wall thickness of 0.6 mm is used. In spite of this extremely small wall thickness, the special shape of the guide webs 20 with their thickened "head" at the free end makes it possible to use an injection molding method to manufacture the guide webs 20. This is most likely in particular due to the fact that, owing to the thickened free end of the guide web 20, a sufficient amount of plastic material flows through the narrowest cross-section of the injection mold, i.e., in the region of the connection of the respective guide web to the seat 10, and no premature solidification of the plastic material will occur there.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An insulating body for a plug connector, the insulating body comprising at least one seat for a contact, the seat being open in a peripheral direction and having an inner surface portion coextensive with a circular cylindrical reference contour, the inner surface portion of the seat surrounding a receiving space for the contact over an angular range which is greater than 180 degrees and smaller than 300 degrees, wherein each of two opposing peripheral edges of the seat has a respective guide web provided thereon which is elastic in a radial direction of the seat and which has a wall thickness that is greater at a free end than in a region of a connection to the seat, and wherein a respective inner surface of each guide web in an undeformed state is positioned within the circular cylindrical reference contour.

2. The insulating body according to claim 1, wherein, for each guide web, the free end of the guide web has a wall thickness which is between 20% and 70% greater than in the region of the connection to the seat.

3. The insulating body according to claim 1, wherein guide webs are symmetrically opposite to each other.

4. The insulating body according to claim 3, wherein the free ends of the guide webs are opposite each other at a distance which is on the order of 10% to 40% of a diameter of the seat.

5. The insulating body according to claim 1, wherein each guide web is curved.

6. The insulating body according to claim 1, wherein the insulating body is made from an injection molded plastic material.

7. An insulating body for a plug connector, the insulating body comprising at least one seat for a contact, the seat being open in a peripheral direction and having an inner surface portion coextensive with a circular cylindrical reference contour, the inner surface portion of the seat surrounding a receiving space for the contact over an angular range which is greater than 180 degrees and smaller than 300 degrees, wherein each of two opposing peripheral edges of the seat has a respective guide web provided thereon which is elastic in a radial direction of the seat and which has a wall thickness that is greater at a free end than in a region of a connection to the seat, and wherein a respective outer surface of each guide web facing away from the seat extends concentrically with a central axis of the seat.

8. An insulating body for a plug connector, the insulating body comprising at least one seat for a contact, the seat being open in a peripheral direction and having an inner surface portion coextensive with a circular cylindrical reference contour, the inner surface portion of the seat surrounding a receiving space for the contact over an angular range which is greater than 180 degrees and smaller than 300 degrees, wherein each of two opposing peripheral edges of the seat has a respective guide web provided thereon which is elastic in a radial direction of the seat and which has a wall thickness that is greater at a free end than in a region of a connection to the seat, wherein a respective inner surface of each guide web facing the seat extends in a curved shape, and wherein a radius of curvature of the respective inner surface of each guide web substantially corresponds to a radius of the seat.

9. An insulating body for a plug connector, the insulating body comprising at least one seat for a contact, the seat being open in a peripheral direction and having an inner surface portion coextensive with a circular cylindrical reference contour, the inner surface portion of the seat surrounding a receiving space for the contact over an angular range which is greater than 180 degrees and smaller than 300 degrees, wherein each of two opposing peripheral edges of the seat has a respective guide web provided thereon which is elastic in a radial direction of the seat and which has a wall thickness that is greater at a free end than in a region of a connection to the seat, wherein a respective inner surface of each guide web facing the seat extends in a curved shape, and wherein each guide web has a maximum wall thickness on the order of 0.4 mm to 0.8 mm.

10. An insulating body for a plug connector, the insulating body comprising at least one seat for a contact, the seat being open in a peripheral direction and having an inner surface portion coextensive with a circular cylindrical reference contour, the inner surface portion of the seat surrounding a receiving space for the contact over an angular range which is greater than 180 degrees and smaller than 300 degrees, wherein each of two opposing peripheral edges of the seat has a respective guide web provided thereon which is elastic in a radial direction of the seat and which has a wall thickness that is greater at a free end than in a region of a connection to the seat, and wherein a respective inner surface of each guide web immediately adjacent to the connection of the guide web to the seat is positioned to be in direct contact with the contact when the contact is received in the seat.

* * * * *